US008091212B2

(12) United States Patent
Kikuchi et al.

(10) Patent No.: US 8,091,212 B2
(45) Date of Patent: Jan. 10, 2012

(54) METHOD OF MANUFACTURING PANEL SWITCH

(75) Inventors: Hidetake Kikuchi, Fukuoka (JP); Toshihiko Terashita, Fukuoka (JP); Tsuyoshi Inoue, Fukuoka (JP); Takashi Kawamura, Fukuoka (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 867 days.

(21) Appl. No.: 12/147,013

(22) Filed: Jun. 26, 2008

(65) Prior Publication Data

US 2009/0000934 A1 Jan. 1, 2009

(30) Foreign Application Priority Data

Jun. 28, 2007 (JP) ..... P2007-171120

(51) Int. Cl.
*H01H 11/00* (2006.01)
*H01H 65/00* (2006.01)

(52) U.S. Cl. ..... 29/622; 29/825; 29/846; 29/874

(58) Field of Classification Search ..... 29/622, 29/412, 825, 832, 842, 846, 874; 156/89.12, 156/267; 200/11 R, 314, 512, 513, 516; 400/472, 473, 476
See application file for complete search history.

(56) References Cited

U.S. PATENT DOCUMENTS 5,071,088 A * 12/1991 Betts ..... 244/12.1
7,301,114 B2 * 11/2007 Sano et al. ..... 200/512
2002/0000979 A1 1/2002 Furuhashi
2003/0089585 A1 5/2003 Koyama
2005/0167258 A1 8/2005 Sano
2005/0271442 A1 12/2005 Ho

FOREIGN PATENT DOCUMENTS

| | | |
|---|---|---|
| EP | 1 030 333 | 8/2000 |
| JP | 2002-8485 | 1/2002 |
| JP | 2003 100165 | 4/2003 |
| JP | 2005-216799 | 8/2005 |
| JP | 2005-254301 | 9/2005 |
| JP | 2005-259460 | 9/2005 |
| JP | 2007-141814 | 6/2007 |

* cited by examiner

*Primary Examiner* — Thiem Phan
(74) *Attorney, Agent, or Firm* — Whitham Curtis Christofferson & Cook, PC

(57) ABSTRACT

A method of manufacturing a panel switch is provided. The panel switch includes insulating films and a base layer having a stationary contact. Each insulating film includes an adhesive layer, and an apex portion of a moving contact adhered to the adhesive layer. The insulating films are aligned and adhered on top of each other and the adhered insulating films are aligned and adhered to the base layer such that the locations of the moving contacts of the respective insulating films align with the stationary contact of the base layer. The method includes applying an adhesive layer to an insulating film; adhering a moving contact onto the adhesive layer; aligning the moving contact with a stationary contact of a base member and adhering the insulating film to the base member; and cutting and removing an excess portion from the insulating film with a laser.

1 Claim, 19 Drawing Sheets

FIG. 21A
RELATED ART
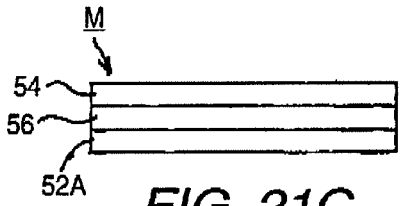
FIG. 21B
RELATED ART
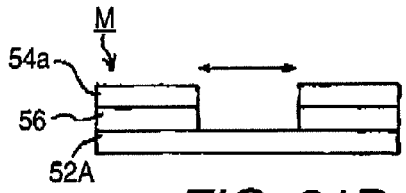
FIG. 21C
RELATED ART
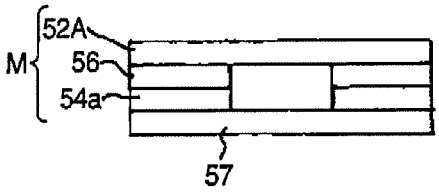
FIG. 21D
RELATED ART
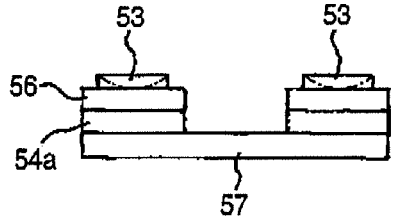
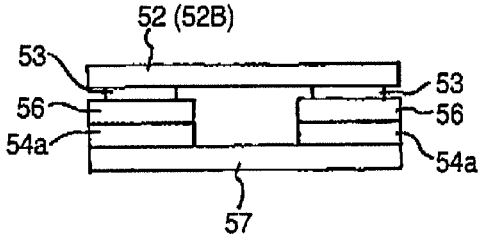
FIG. 21E
RELATED ART

METHOD OF MANUFACTURING PANEL SWITCH

This application claims priority from Japanese Patent Application No. 2007-171120 filed Jun. 28, 2007, the entire contents of which are herein incorporated by reference.

BACKGROUND

Devices and methods consistent with the present invention relate to switches and their manufacture and, more particularly, to a panel switch for use in electronic equipment, and methods of manufacturing the same.

Recently, a sheet-shaped panel switch has become widely used. For example, Japanese Patent Publication No. 2003-100165A describes a related art sheet-shaped panel switch.

FIG. 15 shows a perspective view of a related art panel switch and FIG. 16 shows an enlarged sectional view taken on line C-C in FIG. 15. The related art panel switch 51 includes a wiring board 52; a plurality of moving contacts 53 arranged on the wiring board 52; and a plurality of insulating film pieces 54*a* which are attached onto the wiring board 52 in such a manner that they cover the individual moving contacts 53.

As shown in FIG. 16, on the wiring board 52, a stationary contact 55 is provided for each of the plurality of moving contacts 53. The plurality of stationary contacts 55 are respectively provided by means of printing in a plurality of portions forming a switch portion on a surface of the sheet-shaped insulating film. Each stationary contact 55 includes an outside electrode 55*a* formed into a substantially annular shape and a central electrode 55*b* provided in a central portion surrounded by the outside electrode 55*a*. Although not shown in the drawings, the outside electrode 55*a* and the central electrode 55*b* are respectively connected to a connector terminal portion which is electrically connected to an external circuit.

Each moving contact 53 includes a lower side contact portion 53*a* which is formed as a circular-plate-shaped body formed out of an elastic metallic sheet, the shape of which is swelled into a dome-shape, so that it can be arranged on the outside electrode 55*a* of the wiring board 52; and an apex portion 53*b* arranged being opposed to the central electrode 55*b*. As noted above, the plurality of moving contacts 53 are arranged on the wiring board 52 corresponding to the plurality of stationary contacts 55.

Each insulating film piece 54*a* is formed by a flexible sheet-shaped insulating film that is divided into a plurality of sections which correspond to the plurality of moving contacts 53 by being cut into a predetermined size. On one side, i.e., an inside, of the insulating film piece 54*a*, an adhesive layer 56 (shown in FIG. 16) is provided. The insulating film piece 54*a* is attached onto the wiring board 52 by an adhesive force of the adhesive layer 56 which adheres the insulating film piece 54*a* to the moving contact 53.

Next, an operation of the related art panel switch 51 will be explained. If a pushing force is not given to the panel switch 51, the moving contact 53, being formed into a dome-shape, is swelled to the insulating film piece 54*a* side. Thus, the apex portion 53*b* of the moving contact 53 is separated from the central electrode 55*b*, and a state of switch-off is maintained. I.e., the switch is not conducting. FIG. 16 shows the related art panel switch 51 in the state of switch-off.

On the other hand, if the insulating film piece 54*a* is pushed onto the wiring board 52 side by a pushing force generally orthogonal to a plane of the wiring board 52, the insulating film piece 54*a* and the moving contact 53 are pressed downward along the dome-shape. Therefore, the apex portion 53*b* of the moving contact 53 comes into contact with the central electrode 55*b* and the switch is put into a state of switch-on. I.e., the switch conducts.

If the pushing force given to the insulating film piece 54*a* is released, the apex portion 53*b* of the moving contact 53 is returned to the initial position together with the insulating film piece 54 by an elastic returning force of the moving contact 53. Accordingly, the apex portion 53*b* is separated from the central electrode 55*b* again and the switch is put into a state of switch-off.

Next, referring to FIGS. 17 to 21E, a related art procedure for manufacturing the related art panel switch 51 will be explained. First, a sheet-shaped switch forming material M for forming the panel switch 51 is prepared. As shown in FIGS. 17 and 21A, the switch forming material M includes an insulating film 54, an adhesive layer 56, and a separator 52A. The adhesive layer 56 is provided on one side of the insulating film 54, and the separator 52A is provided on the other side of the adhesive layer 56. Thus, the adhesive layer 56 adheres the separator 52A to the insulating film 54. The insulating film 54 has a size capable of being divided into the plurality of insulating film pieces 54*a*.

Next, as shown in FIG. 21B, the insulating film 54 and the adhesive layer 56 of the switch forming material M are cut into a predetermined size by using a metallic die (not shown). Thus, a plurality of divided insulating film pieces 54*a* are obtained. After that, as shown in FIG. 21C, the switch forming material M is inverted so that the separator 52A is located on the upper side and the insulating film pieces 54*a* are set at predetermined positions on a jig 57 in order.

Successively, the separator 52A is removed as shown in FIG. 18. Then, as shown in FIGS. 19 and 21D, the plurality of moving contacts 53, which are turned upside down, are arranged and made to adhere onto the insulating film pieces 54*a* so that the apex portion 53*b* of the dome-shaped moving contact 53 can be made to adhere onto the adhesive layer 56. An outside dimension of the moving contact 53 is set to be smaller than that of each insulating film piece 54*a*. Therefore, the moving contact 53 is covered with the corresponding insulating film piece 54*a*.

After the plurality of moving contacts 53 have been made to adhere onto the adhesive layer 56, as shown in FIGS. 20 and 21E, the wiring board 52 is set on the plurality of moving contacts 53 and, the plurality of moving contacts 53 are adhered and fixed to the wiring board 52. It is also possible to use a separator 52B in place of the wiring board 52. In order to align the wiring board 52 with the sheet having plurality of moving contacts 53, two positioning pins 58 are arranged on the right and two positioning pins 58 are arranged on the left so as to be protruded from the jig 57. In other words, four positioning pins 58 in total are protruded from the jig 57. Accordingly, when the insulating film pieces 54*a* are put at predetermined positions on the jig 57, the positioning pins 58 provided on the jig 57 are inserted into positioning holes 59 provided on the wiring board 52, so that adhesion can be made under the condition that the insulating film pieces are properly positioned.

Next, an unnecessary portion of the wiring board 52 is removed by being cut off. For example, an unnecessary portion of the wiring board 52 corresponding to a portion between the moving contacts 53, which are adjacent to each other, is cut off. Finally, the insulating film pieces 54*a* are removed from the jig 57, and the related art manufacturing process of the related art panel switch 51 is completed.

However, the above-described related art panel switch and related art manufacturing process has a number of disadvantages. First, in the related art process of manufacturing the related art panel switch 51, it is necessary that a plurality of insulating film pieces 54*a* are punched from the insulating film 54 by using a metallic die and the thus insulating film pieces 54*a* are punched on the jig 56 in order. Accordingly, related art process requires many man-hours to produce the related art panel switch, thus increasing the manufacturing cost. Moreover, in the case where a profile of the insulating film piece 54*a* is changed, it is necessary to also change the metallic mold. Accordingly, this results in increased expenses and increased time for manufacturing. Lastly, the touch and feel of the related art panel switch is controlled by the dome-shaped moving contact, and accordingly, there is little variation possible in the touch and feel.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

According to an exemplary embodiment of the present invention, there is provided a method of manufacturing a panel switch, the method comprising a moving contact sticking operation in which a swelled apex portion of a dome-shaped moving contact is adhered onto an adhesive layer formed on one side of an insulating film; an insulating film sticking operation in which the insulating film is adhered onto a base member having a stationary contact corresponding to the moving contact so as to fix the moving contact to the base member; and an excess film removing operation in which a laser beam is irradiated onto the insulating film which is adhered to the base member so as to cut off and remove an excess portion of the insulating film.

According to yet another exemplary embodiment of the present invention, there is provided a method of manufacturing a panel switch, the method comprising applying an adhesive layer on a side of an insulating film; adhering an apex portion of a moving contact onto the adhesive layer; providing a base member comprising a stationary contact; aligning the moving contact with the stationary contact and adhering the insulating film to the base member so as to fix the moving contact to the base member, thus forming an insulating film assembly; and irradiated the insulating film assembly with a laser beam so as to cut off and remove an excess portion from the insulating film.

According to yet another exemplary embodiment of the present invention, there is provided a method of manufacturing a panel switch, the method comprising applying an adhesive layer on a side of a first insulating film; adhering an apex portion of a moving contact onto the adhesive layer of the first insulating film; providing a base member comprising a stationary contact; aligning the moving contact with the stationary contact; adhering the first insulating film to the base member so as to fix the moving contact to the base member; applying an adhesive layer on a side of a second insulating film; adhering an apex portion of a moving contact onto the adhesive layer of the second insulating film; aligning the moving contact of the second insulating film with the moving contact of the first insulating film; adhering the second insulating film on top of the first insulating film such that the moving contact of the first insulating film, the moving contact of the second insulating film and the stationary contact align in a direction orthogonal to a surface of the base member, thus forming an insulating film assembly; and irradiated the insulating film assembly with a laser beam so as to cut off and remove an excess portion of the insulating film from the insulating film assembly.

According to yet another exemplary embodiment of the present invention, there is provided a panel switch comprising a base layer comprising a stationary contact; a first contact portion comprising a first insulating film; an adhesive layer applied to a side of the first insulating film; and a moving contact comprising an apex portion, the apex portion being adhered to the adhesive layer of the first insulating film; and a second contact portion comprising a second insulating film; an adhesive layer applied to a side of the second insulating film; and a moving contact comprising an apex portion, the apex portion being adhered to the adhesive layer of the second insulating film, wherein the first contact portion is adhered to the base member, and the second contact portion is adhered to the first contact portion, such that the moving contact of the first contact portion, the moving contact of the second contact portion, and the stationary contact are aligned with each other in a direction orthogonal to a surface of the base member.

BRIEF DESCRIPTION OF THE DRAWINGS

The above and other aspects of the present invention will become more apparent by describing in detail exemplary embodiments thereof with reference to the accompanying drawings, wherein:

FIGS. 7A to 7C are overall arrangement views of a film cutter used to remove film according to the method of FIG. 3, wherein FIG. 7A shows a state of the film cutter in which an X-Y table is arranged at a starting position, FIG. 7B shows a state of the film cutter in which the X-Y table is arranged at an image reading position, and FIG. 7C shows a state of the film cutter in which the X-Y table is arranged at a laser beam cutting position;

FIGS. 8A to 8E are views of manufacturing operations according the first exemplary embodiment of the present invention, wherein FIG. 8A shows a switch forming material, FIG. 8B shows a state in which the switch forming material is fixed to a jig, FIG. 8C shows a state in which moving contacts are attached to an insulating film, FIG. 8D shows a state in which a wiring board is attached onto the moving contacts, and FIG. 8E shows a state in which manufacturing of a panel switch is completed;

FIGS. 21A to 21E are views of a related art manufacturing method, wherein FIG. 21A shows a switch forming material, FIG. 21B shows a state in which an insulating film of the switch forming material is cut and divided into a plurality of pieces, FIG. 21D shows a state in which a switch forming element is inverted and fixed onto a jig, FIG. 21D shows a state in which moving contacts are attached onto an insulating film, and FIG. 21E shows a state in which a wiring board is attached onto moving contacts.

DETAILED DESCRIPTION OF EXEMPLARY EMBODIMENTS

Hereinafter, embodiments of the present invention will be described with reference to the accompanying drawings.

First Exemplary Embodiment

Figure 1:
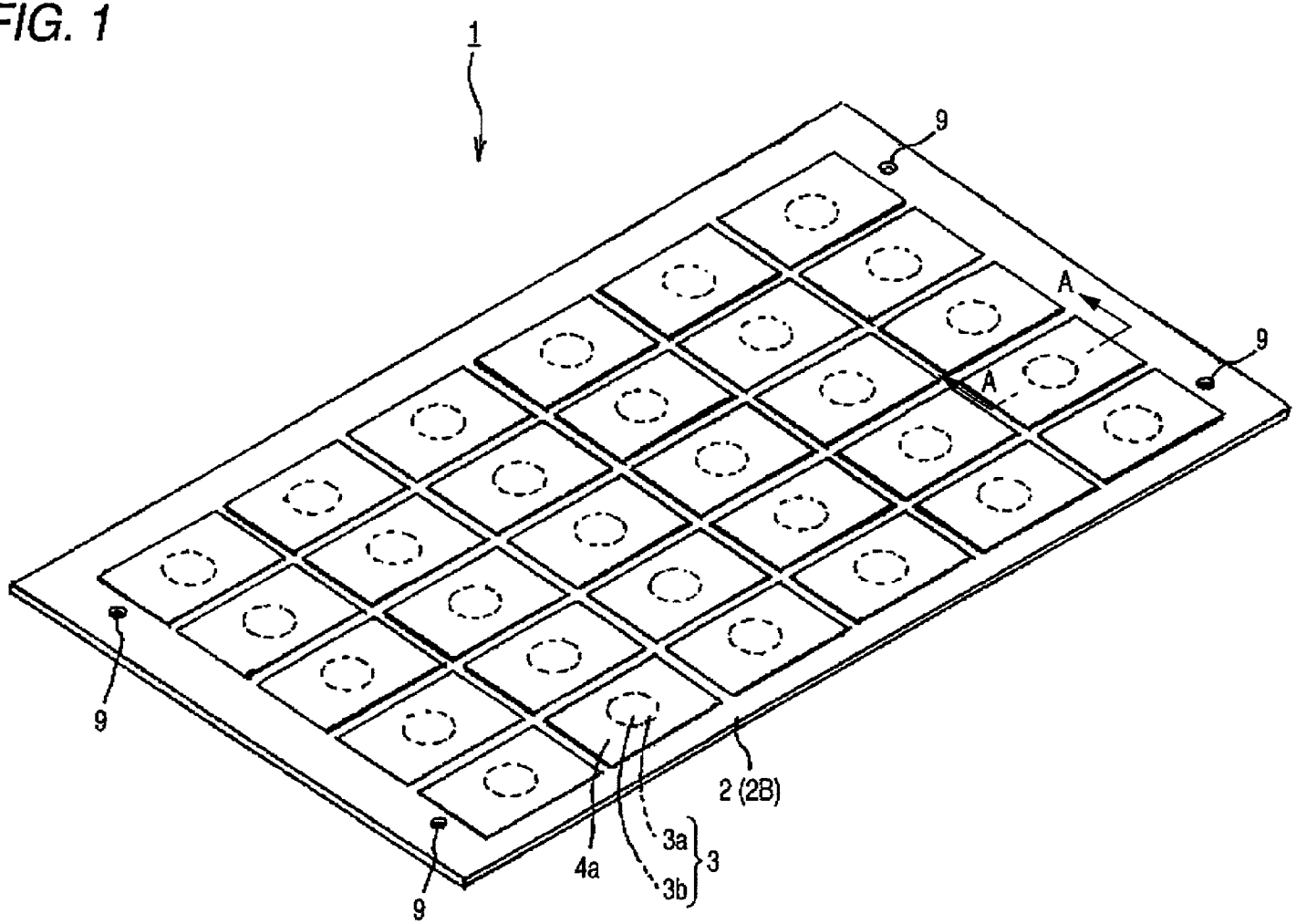
FIG. 1 is a perspective view of a panel switch according to a first exemplary embodiment of the present invention.
Figure 2:
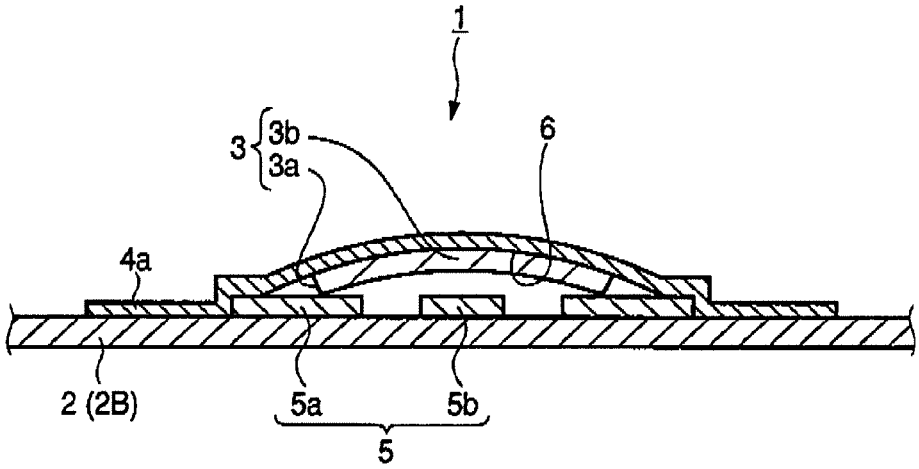
FIG. 2 is an enlarged sectional view taken along line A-A in FIG. 1.

Referring to FIGS. 1 and 2, a panel switch 1 includes a wiring board (base member) 2 having a plurality of stationary contacts 5; a plurality of moving contacts 3 arranged on the wiring board 2; and a plurality of insulating film pieces 4*a* attached onto the wiring board 2 so as to respectively cover the moving contacts 3.

As shown in FIG. 2, on the wiring board 2, stationary contacts 5 are respectively provided by means of printing in a plurality of portions forming a switch portion on a surface of the sheet-shaped insulating film. Each stationary contact 5 includes an outside electrode 5*a* formed into a substantially annular shape, and a central electrode 5*b* provided in a central portion surrounded by the outside electrode 5*a*. The outside electrode 5*a* and the central electrode 5*b* are respectively coupled to a connector terminal portion (not shown) which is electrically coupled to an external circuit.

Each moving contact 3 is made from a swelled circular-plate-shaped body formed out of an elastic metallic sheet. The shape of the swelled circular-plate shaped body is a dome-shape. The moving contact 3 includes a lower side contact portion 3*a* which is formed into a size so that the lower side contact portion 3*a* can be arranged on the outside electrode 5*a* of the wiring board 2, and an apex portion 3*b* arranged so as to be opposed to the central electrode 5*b*. A plurality of moving contacts 3 are arranged on the wiring board 2 corresponding to a plurality of stationary contacts 5. In this exemplary embodiment, the panel switch 1 has 30 moving contacts 3. However, this number of contacts is only exemplary, and the present inventive concept applies equally to a panel switch 1 having any number of switches.

Each insulating film piece 4*a* is formed when a flexible sheet-shaped insulating film is divided by being cut to a certain size. The insulating film piece 4*a* functions as a cover tape for covering the moving contact 3. On one side, e.g., an inside, of the insulating film piece 4*a*, an adhesive layer 6 (shown in FIG. 2) is provided. The insulating film piece 4*a* together with the moving contact 3 is attached onto the wiring board 2 by an adhesive force of the adhesive layer 6.

The operation of the panel switch 1 will now be explained. If the panel switch 1 is not given a pushing force, the moving switch 3 is swelled upward, as shown in FIG. 2. In other words, the moving switch 3 is swelled like a dome-shape onto the insulating film 4*a* side and the apex portion 3*b* of the moving contact 3 is separated from a surface of the central electrode 5*b*. Therefore, the central electrode 5*b* does not conduct with the outside electrode 5*a*, and the moving contact 3 is maintained in a state of switch-off.

On the other hand, if the insulating film piece 4*a* is operated by being pushed towards the wiring board 2, i.e., in a direction roughly orthogonal to the wiring board 2, the insulating film piece 4*a* and the moving contact 3 are pressed orthogonally to the dome-shape. Therefore, the apex portion 3*b* of the moving contact 3 comes into contact with the central electrode 5*b*. Accordingly, the central electrode 5*b* is brought into a conducting condition with the outside electrode 5*a*, and the moving contact 3 is put into a state of switch-on. If the pushing force given to the insulating film piece 4*a* is released, the apex portion 3*b* of the moving contact 3 is raised and returned to the initial dome-shape position together with the insulating film piece 4*a* by the elastic returning force of the moving contact 3. As a result, the apex portion 3*b* is separated from the central electrode 5*b* again and the moving contact 3 is changed over to a state of switch-off.

Figure 3:
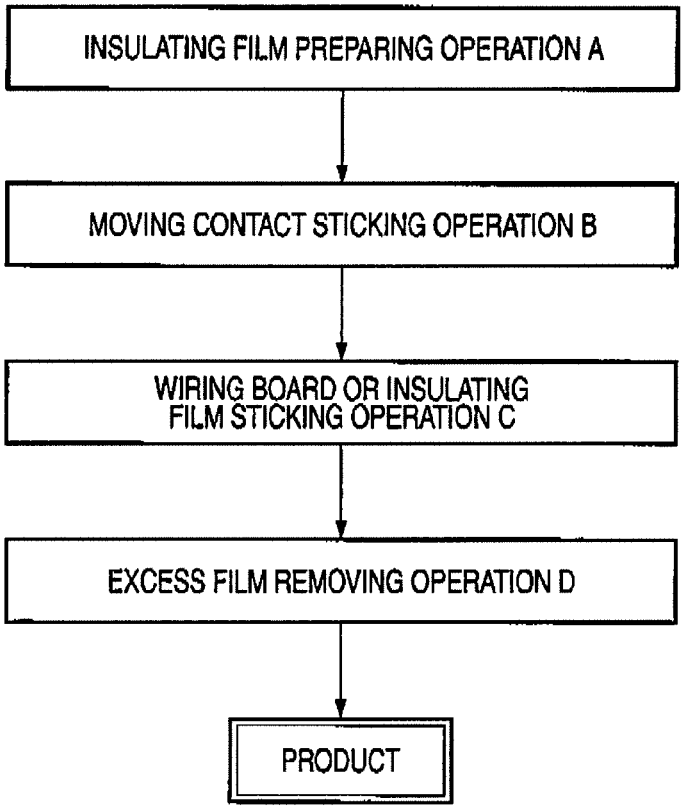
FIG. 3 is a process block diagram of a method of manufacturing a panel switch according to the first exemplary embodiment of the present invention.

Referring to FIGS. 3 to 8E, a manufacturing procedure of the above-described panel switch 1 will now be explained. FIG. 3 is a process block diagram showing a procedure of the manufacturing method according to a first exemplary embodiment of the present invention. The manufacturing method according to the first exemplary embodiment of the present invention includes an insulating film preparing operation A, a moving contact sticking operation B, an insulating film sticking operation C; and an excess film removing step D. The operations A to D will now be described in detail.

Figure 8A:
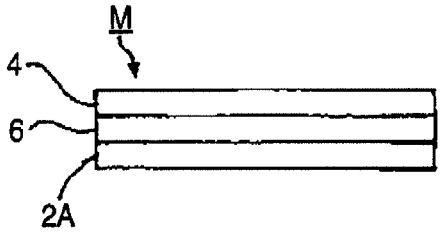
Figure 8B:
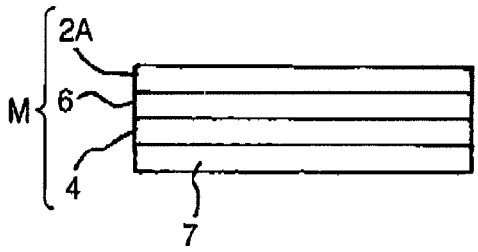

In the insulating film preparing operation A, a sheet-shaped switch forming material M is prepared. As shown in FIG. 8A, the switch forming material M comprises an insulating film 4, an adhesive layer 6, and a separator 2A. The adhesive layer 6 is provided on one side of the insulating film 4, and the separator 2A is stuck and fixed onto the adhesive layer 6. As shown in FIG. 8B, the switch forming material M is set so that the separator 2A can be directed upward, i.e., away from the jig, and the insulating film 4 on the lower face side of the switch forming material M is set and stuck onto the jig 7. In this way, the switch forming material M is fixed onto the jig 7.

On the jig 7, four positioning pins 8 are provided such that the four positioning pins 8 protrude from the jig 7. In this exemplary embodiment, two positioning pins are arranged on the right side and two positioning pins are arranged on the left side of the jig 7. Accordingly, when the switch forming material M is arranged on the jig 7, the switch forming material M can be accurately positioned and fixed by the pairs of pins 8. In other words, the switch forming material M is placed within the four protruding positioning pins 8 and the switch forming material M is held in between the four protruding positioning pins 8 by friction.

It is possible to provide positioning holes in the switch forming material M, and the positioning holes may then be aligned with the four protruding positioning pins 8 so as to align the switch forming material M in the jig 7. As will be described in more detail below, the wiring board 2 is formed with positioning holes 9 for arranging and fixing the wiring board 2 onto the jig 7. The insulating film 4 is formed from a film sheet and the size of the insulating film sheet is sufficiently large so that a desired number of sheets of insulating film pieces 4*a* can be obtained. For example, in this exemplary embodiment, the insulating film sheet is large enough to provide 30 insulating film pieces 4*a*. However, an area of the insulating film 4 is approximately half of an area of the insulating film used to produce the related art panel switch since the laser processing requires smaller area of an excess portion 4*b*.

Figure 4:
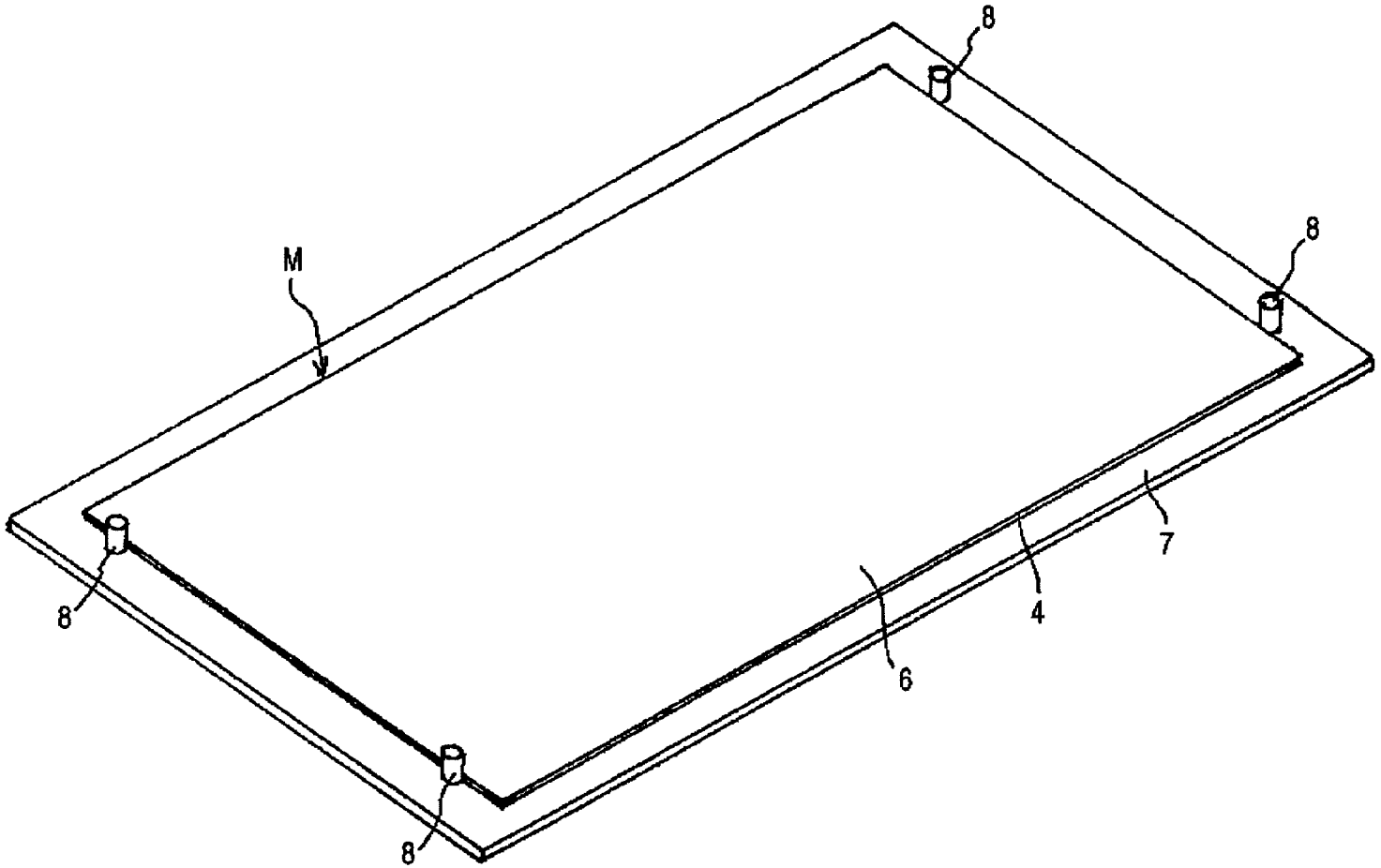
FIG. 4 is a schematic illustration of an insulating film arranged on a jig according to the method of FIG. 3.
Figure 5:
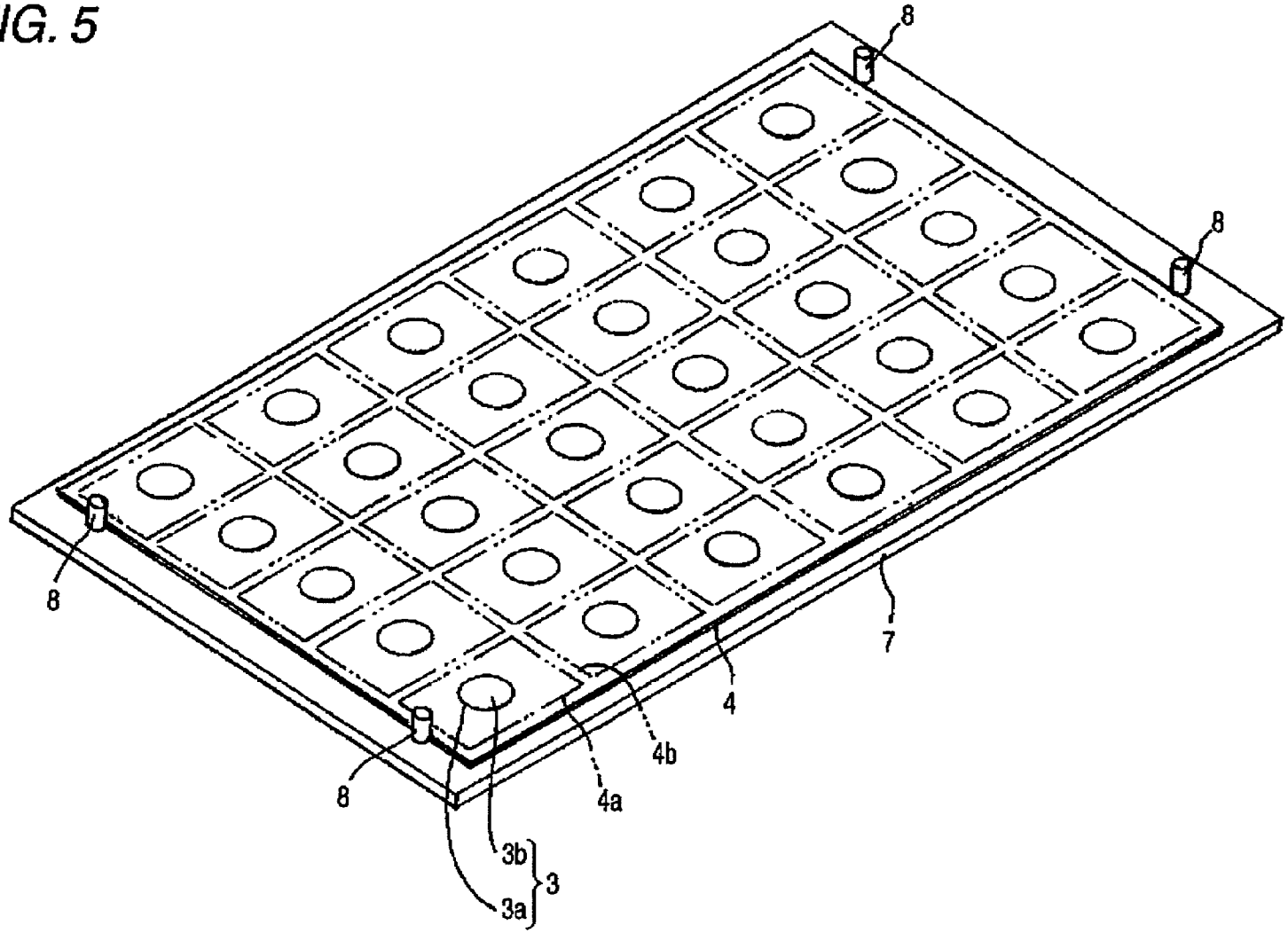
FIG. 5 is a schematic illustration of moving contacts arranged on the insulating film according to the method of FIG. 3.
Figure 8C:
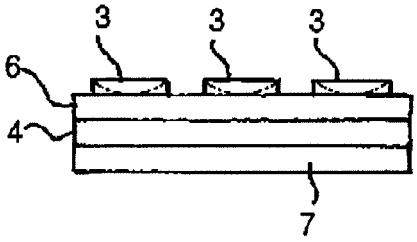

The process then proceeds to the moving contact sticking operation B. As shown in FIG. 4, the separator 2A stuck onto the adhesive layer 6 of the insulating film 4 is removed. Then, as shown in FIG. 5 and FIG. 8C, the moving contacts 3 are arranged and fixed onto a plurality of portions of the adhesive layer 6 on which the insulating film pieces 4*a* described later are scheduled to be formed. The moving contacts 3 are turned upside down before being arranged and stuck to the adhesive layer 6 such that the apex portions 3*b* of the dome-shaped moving contacts 3, which are shown by one-dotted chain lines in FIG. 8C, can be stuck and fixed at desired positions on the insulating film 4.

Accordingly, a number of moving contacts 3 are respectively stuck and arranged at a plurality of positions on the insulating film 4. The number of moving contacts 3 and their positions on the insulating film 4 may be predetermined. An outside dimension of each moving contact 3 is set to be smaller than an outside dimension of the insulating film piece 4*a* which corresponds to the moving contact 3. Therefore, each moving contact 3 is covered with a corresponding insulating film piece 4*a*.

Figure 8D:
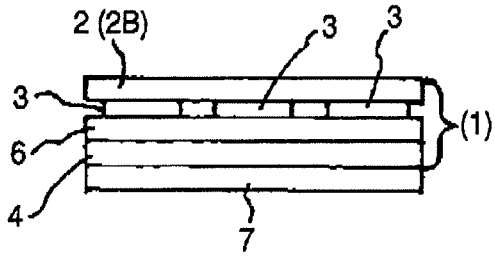

The process then proceeds to the insulating film sticking operation C. As shown in FIG. 8D, a sheet of wiring board 2 is set on the plurality of moving contacts 3. Alternatively, a sheet of separator 2B may be used in place of the wiring board 2. Positioning holes 9 corresponding to the positioning pins 8 of the jig 7 are formed on the wiring board 2. Therefore, when the positioning pins 8 are inserted into and engaged with the positioning holes 9, the wing board 2 can be accurately positioned with respect to the jig 7.

Figure 6:
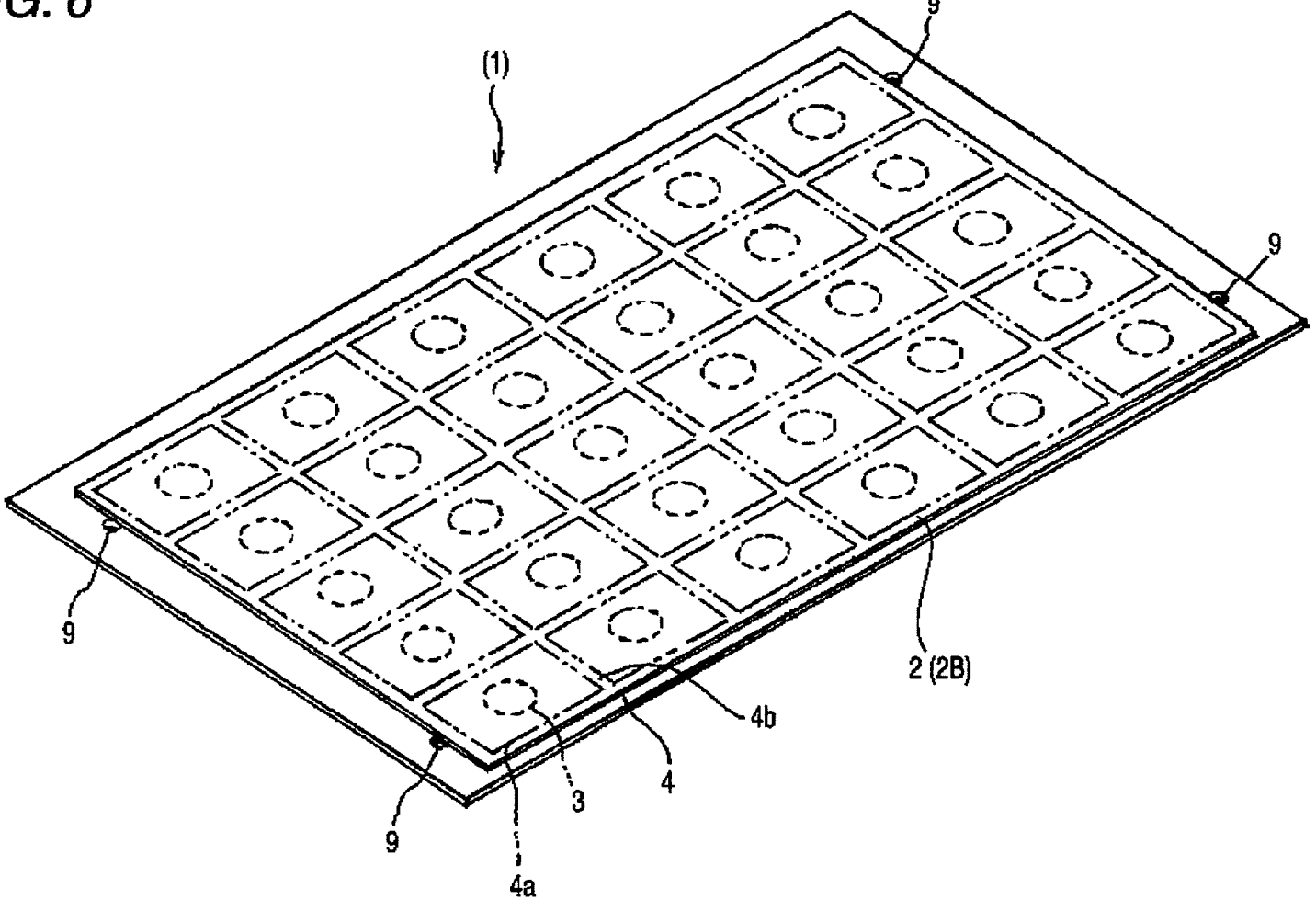
FIG. 6 is a schematic illustration of the insulating film and moving contacts arranged on a wiring board according to the method of FIG. 3.

The insulating film 4 and the wiring board 2 are removed from the jig 7 together with the moving contacts 3. Successively, as shown in FIG. 6, while the dome-shapes of the moving contacts 3 are being maintained, the insulating film 4 and the wiring board 2 are closely contacted with each other. In other words, the areas of the insulating film 4 around the moving contacts 3 are pressed to the wiring board 2 while the dome-shape of the moving contacts 3 is maintained so that the areas of the insulating film 4 around the moving contacts 3 are adhered to the wiring board 2. As a result, the insulating film 4 is strongly stuck and fixed onto a surface of the wiring board 2 by an adhesive force of the adhesive layer 6.

When the insulating film 4 is stuck and fixed as described above, the moving contacts 3 are also fixed and held at the desired positions on the wiring board 2. That is the moving contacts 3 are also fixed and held at the outside electrodes 5*a* of the stationary contacts 5. Accordingly, a partially fabricated product (1) comprising the moving contacts 3 is formed (see FIG. 8D).

Figure 7C:
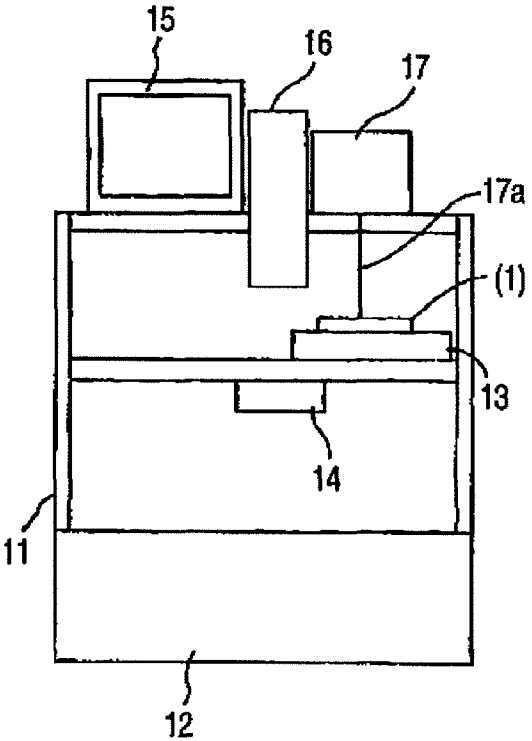
Figure 7B:
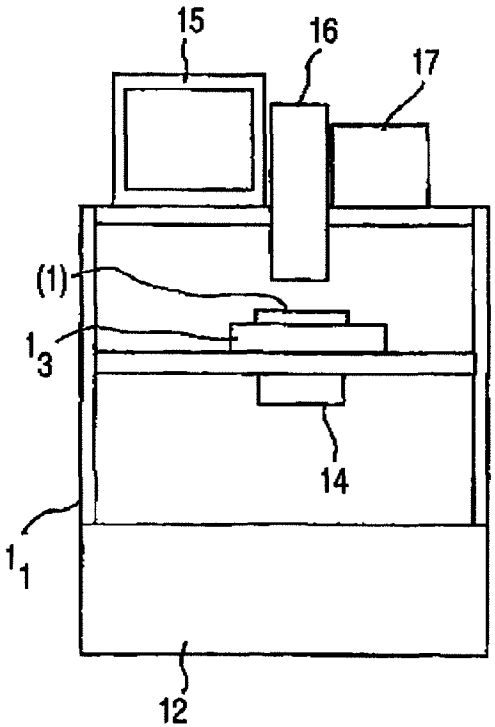
Figure 7A:
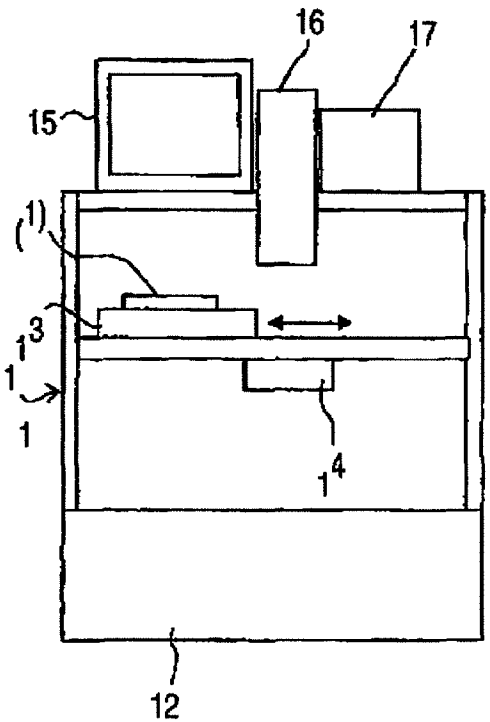

The process then proceeds to the excess film removing operation D. A film cutter 11 shown in FIGS. 7A to 7C is prepared. The film cuter 11 comprises a frame 12, an X-Y table 13, an illuminating device 14, an operation monitor 15, an image recognizing device 16, and a laser beam cutter 17. The X-Y table 13, the illuminating device 14, the operation monitor 15, the image recognizing device 16, and the laser beam cutter 17 are arranged on the frame 12. The operation monitor 15 may incorporate a touch panel. The image recognizing device 16 may include a CCD camera.

Figure 8E:
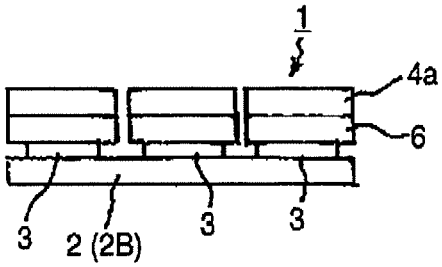

In the excess film removing operation D, the partially fabricated switch product (1 is set on the X-Y table 13, and the X-Y table 13 is moved to into position and the excess portion 4*b* of the insulating film 4 is automatically removed by cutting. Then, the panel switch 1 as shown in FIG. 8E is manufactured.

Operation of the film cutter 11 will be further explained as follows. The X-Y table 13 is started from the position shown in FIG. 7A. Accordingly, at the position shown in FIG. 7A, the insulating film 4 is directed upward and the partially fabricated switch product (1) is set on the X-Y table 13.

The X-Y table 13 is then moved to the position shown in FIG. 7B. At the position shown in FIG. 7B, the X-Y table 13 is arranged between the image recognizing device 16 and the illuminating device 14. At this position, a beam of light is irradiated from the illuminating device 14 onto the lower side of the wiring board 2. Therefore, positions of the moving contacts 3 in the partially fabricated switch product (1) are clearly shown as images on the image recognizing device 16 which is located above the X-Y table 13. These images are photographed by the image recognizing device 16 so that the positions of the moving contacts 3 can be recognized. This image information is input into the laser beam cutter 17.

After the image recognition made by the image recognizing device 16 has been completed, the X-Y table 13 is moved to the position shown in FIG. 7C. At the position shown in FIG. 7C, on the basis of the information recognized by the image recognizing device 16, the laser beam cutter 17 irradiates a laser beam 17*a* onto the boundary line between the insulating film piece 4*a* of the insulating film 4 and the excess portion 4*b* so as to cut and remove the excess portion 4*b* of the insulating film (see, e.g., FIG. 5). Thus, the partially fabricated switch product (1) is completed as a panel switch 1 and removed from the surface of the X-Y table 13 as shown in FIG. 8E. On the other hand, the X-Y table 13 is returned to the starting position shown in FIG. 7A. After that, the same operation is repeated.

When the film cutter 11 is used as described above, the excess film removing operation D is carried out and manufacturing of the panel switch 1, in which the insulating film pieces 4*a*, are individually separated from each other, can be completed.

In this excess film removing operation D, the excess portion 4*b* is cut off in reference to a location of the moving contacts 3. Accordingly, the cutting accuracy can be enhanced and the material yield, and hence also the product yield, can be greatly improved.

Moreover, if a profile of the insulating film piece 4*a* is changed, a command for changing the profile may given to the laser beam cutter 17, and a cutting profile corresponding to the profile of the insulating film piece 4*a* after the change can be easily changed. The command for changing the profile may be given to the laser beam cutter 17 by, for example, operating a touch panel displayed on the operation monitor 15. Alternatively, other ways may also be used to provide the command to the laser beam cutter 17, for example, by using an external programming device, etc.

Second Exemplary Embodiment

Figure 9:
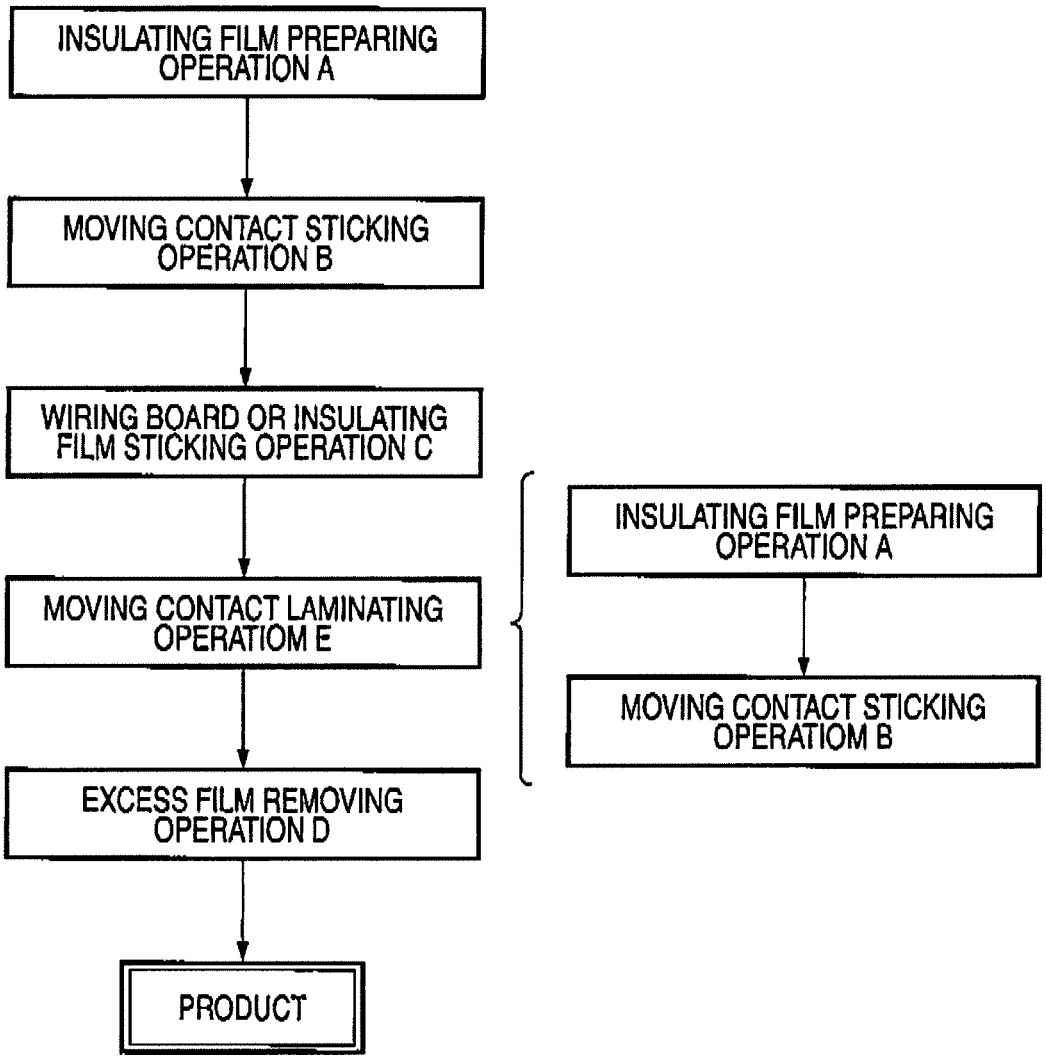
FIG. 9 is a process block diagram showing a method of manufacturing a panel switch according to a second exemplary embodiment of the present invention.

FIG. 9 is a drawing showing a manufacturing method according to a second exemplary embodiment of the present invention. The manufacturing method according to the second exemplary embodiment includes a moving contact laminating operation E that is added to the manufacturing operations A to D of the first exemplary embodiment. Except for the moving contact laminating operation E, the manufacturing method according to the second exemplary embodiment is substantially the same as that of the first exemplary embodiment.

Figure 10:
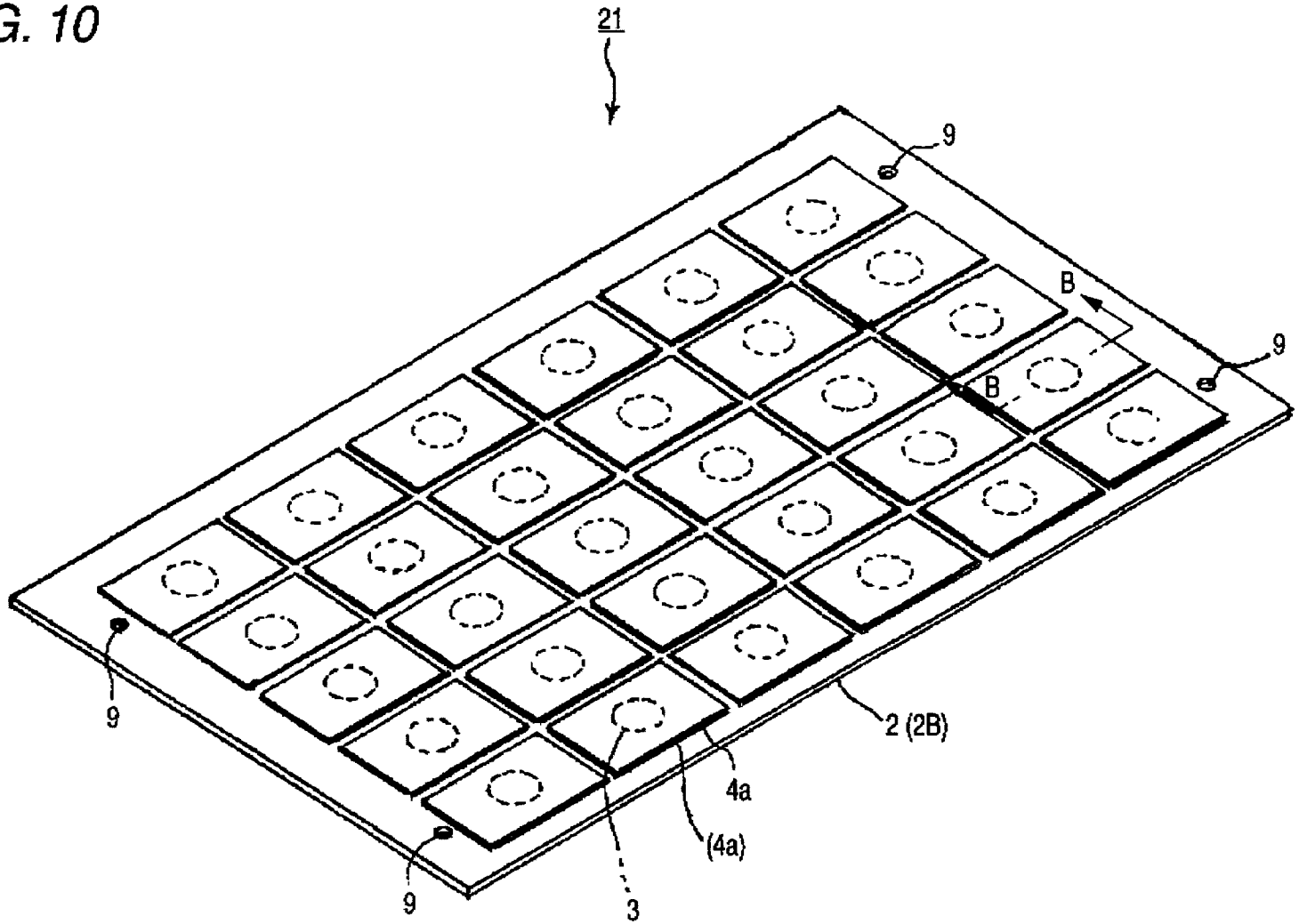
FIG. 10 is a perspective view of a panel switch according to the second exemplary embodiment of the present invention.
Figure 11:
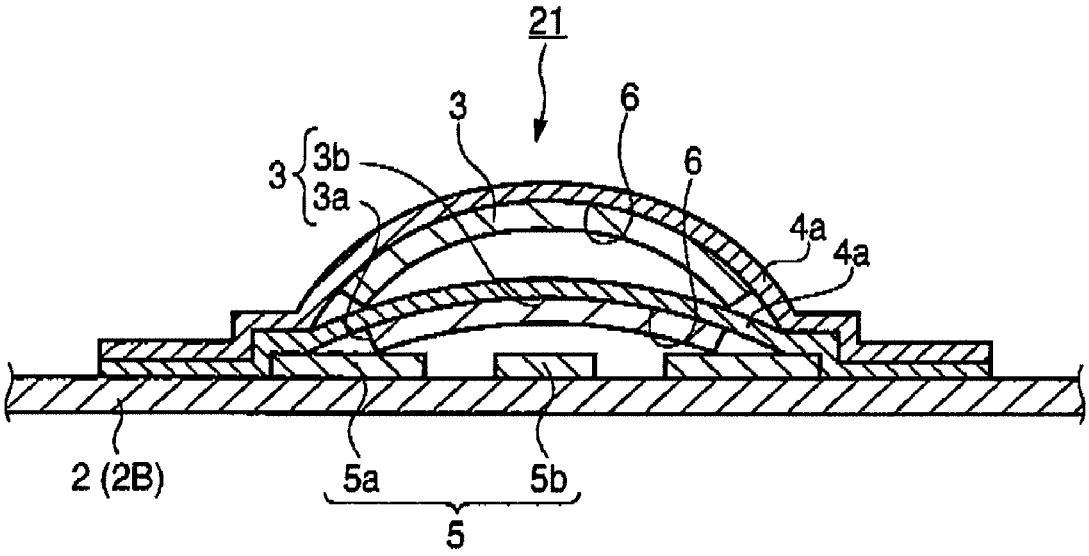
FIG. 11 is an enlarged sectional view taken on line B-B in FIG. 10.

According to the second exemplary embodiment of the present invention, in the panel switch 21 shown in FIG. 10, the moving contacts 3 are attached onto the adhesive layer 6 of the insulating film 4, as in the panel switch according to the first exemplary embodiment. However, in the panel switch 21 according to the second exemplary embodiment, two insulating films 4 having the moving contacts 3 are adhered to each other. Therefore, like reference numbers are used to indicate like components and the detailed explanations of structures that are similar to those of the first exemplary embodiment are omitted here.

Next, referring to FIGS. 9 to 14, a manufacturing method of the panel switch 21 according to the second exemplary embodiment will be explained. First, as shown in FIG. 9, the insulating film preparing operation A, the moving contact sticking operation B and the insulating film sticking operation C are performed. These operations A to C of the second exemplary embodiment are the same as the insulating film preparing operation A, the moving contact sticking operation B and the insulating film sticking operation C of the first exemplary embodiment.

The second exemplary embodiment is characterized in that the moving contact laminating operation E is added after the insulating film sticking operation C. That is, the second exemplary embodiment is characterized in that the insulating film 4 having the moving contacts 3 formed in the moving contact sticking operation B is added onto another insulating film 4 having the moving contacts 3 formed in the same moving contact sticking operation B.

Figure 12:
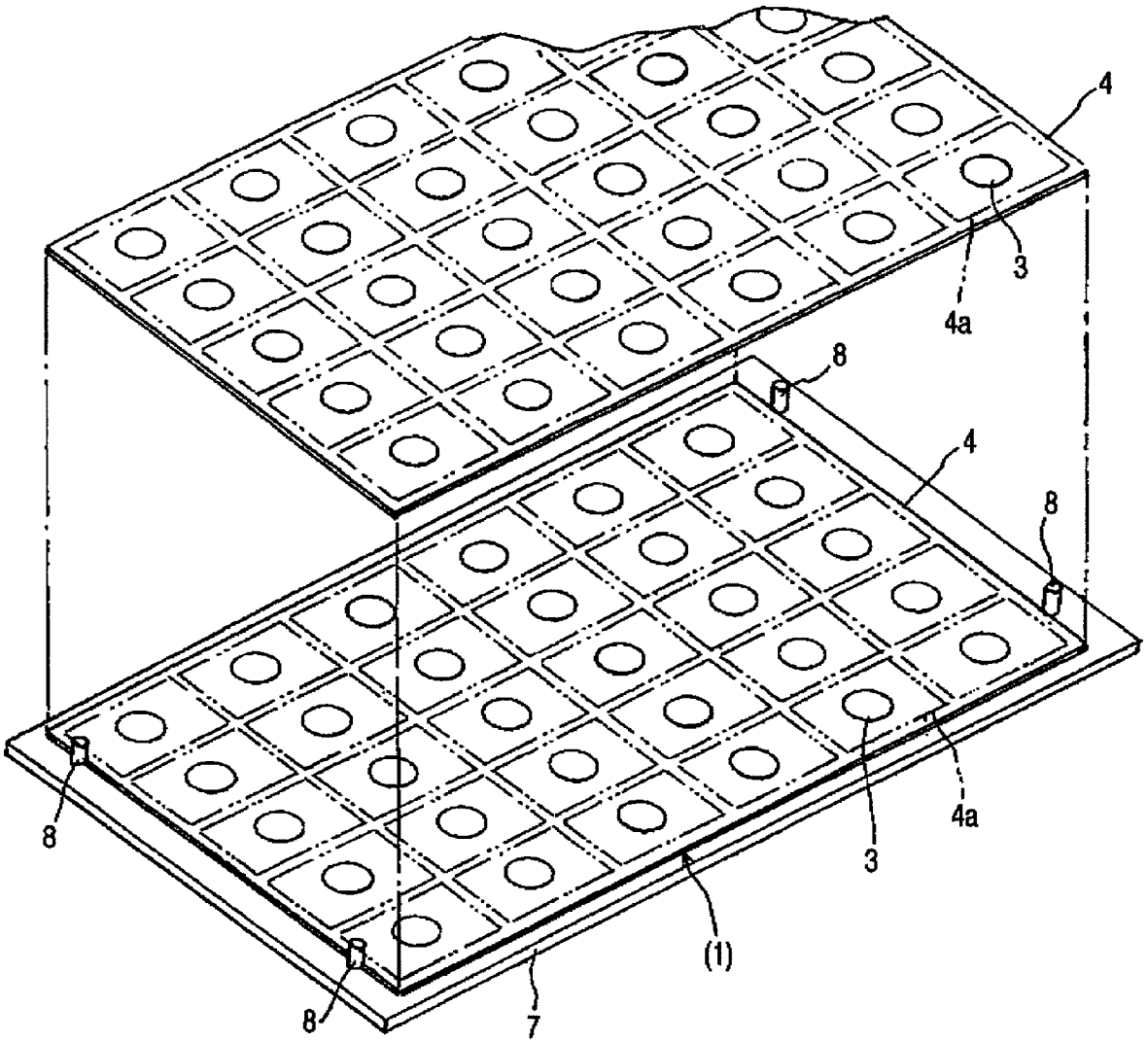
FIG. 12 is a schematic illustration showing a moving contact laminating operation according to the second exemplary embodiment of the present invention.
Figure 13:
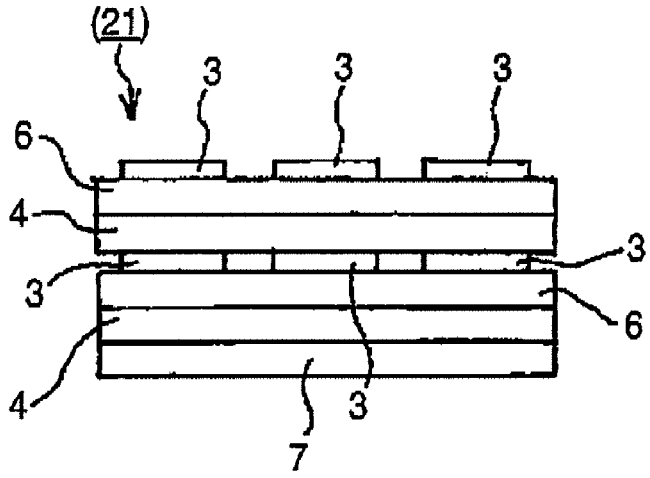
FIG. 13 is a process drawing showing a partially fabricated switch product according to the second embodiment of the present invention.

As shown in FIG. 12, in the moving contact laminating operation E described above, on the insulating film 4 having the moving contacts 3 manufactured in the same manufacturing operation as that of the first exemplary embodiment, another insulating film 4, i.e., a second insulating film, having the moving contacts 3 manufactured through the insulating film preparing operation A and the moving contact sticking operation B is laminated while the upper and the lower moving contacts 3 are being made to correspond to each other. FIG. 13 is a view showing a partially fabricated switch product (21) in which the upper insulating film 4 having the moving contacts 3 and the lower insulating film 4 having the moving contacts 3 are put on each other on the jig 7.

Figure 14:
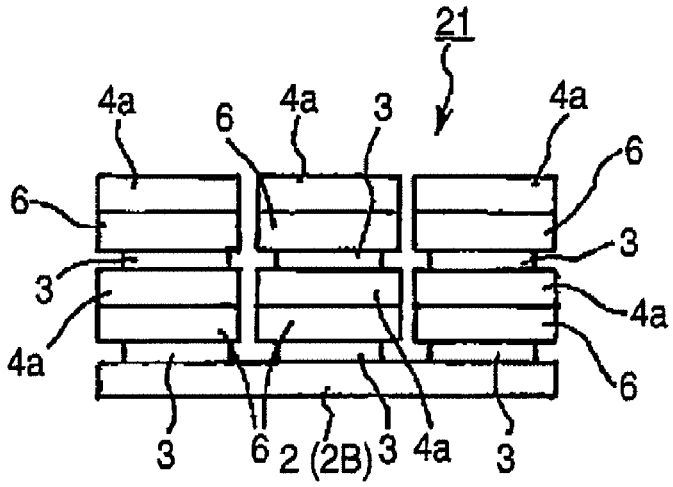
FIG. 14 is a process drawing showing a panel switch formed by using a manufacturing method of manufacturing a panel switch according to the second exemplary embodiment of the present invention.
Figure 15:
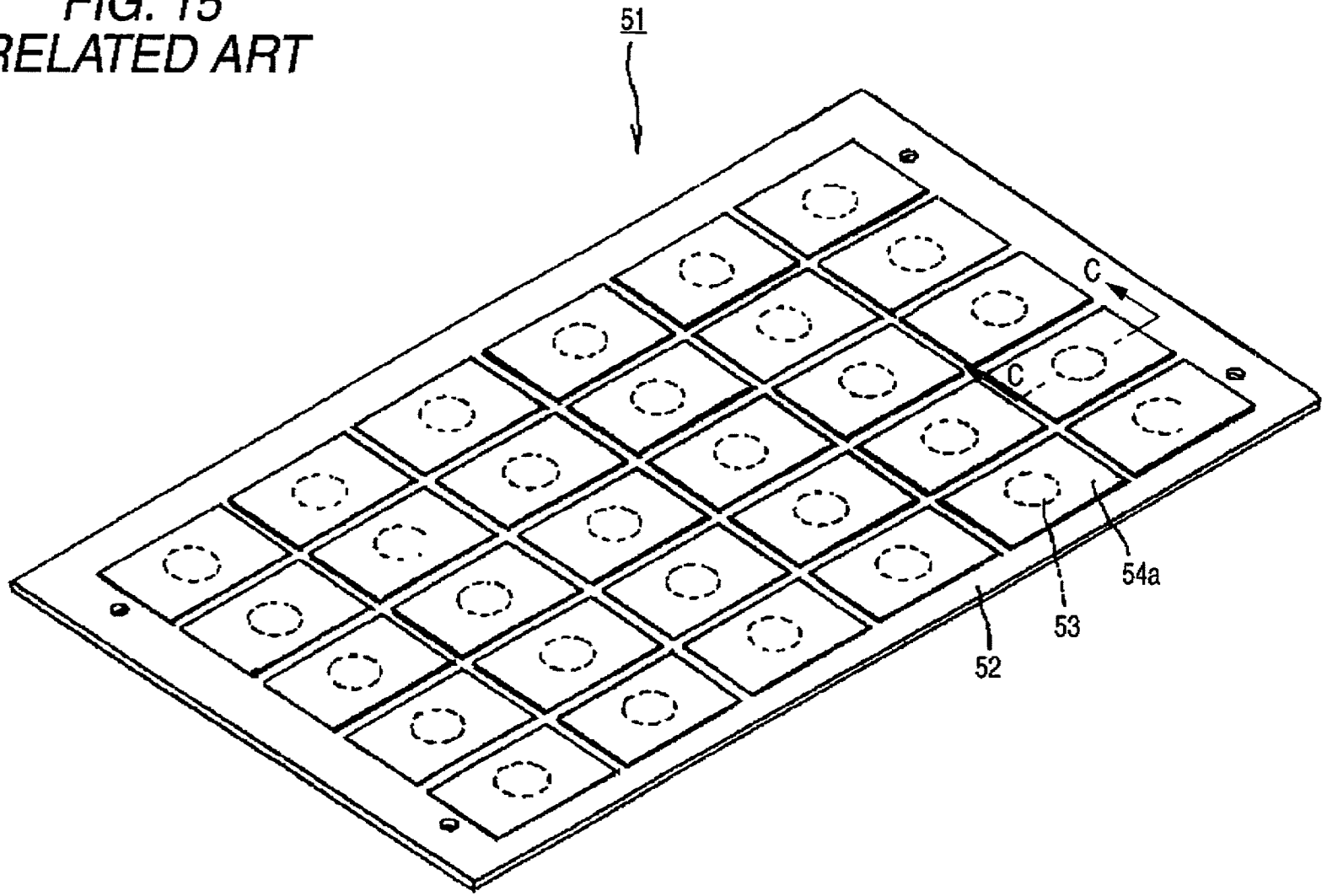
FIG. 15 RELATED ART
FIG. 15 is a perspective view showing a related art panel switch.
Figure 16:
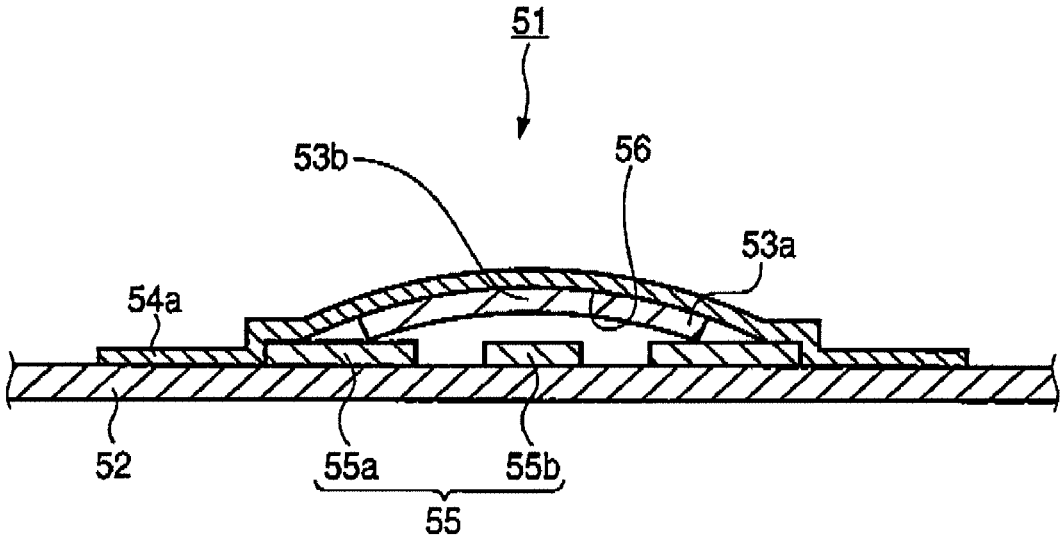
FIG. 16 RELATED ART
FIG. 16 is an enlarged sectional view taken on line C-C in FIG. 15.
Figure 17:
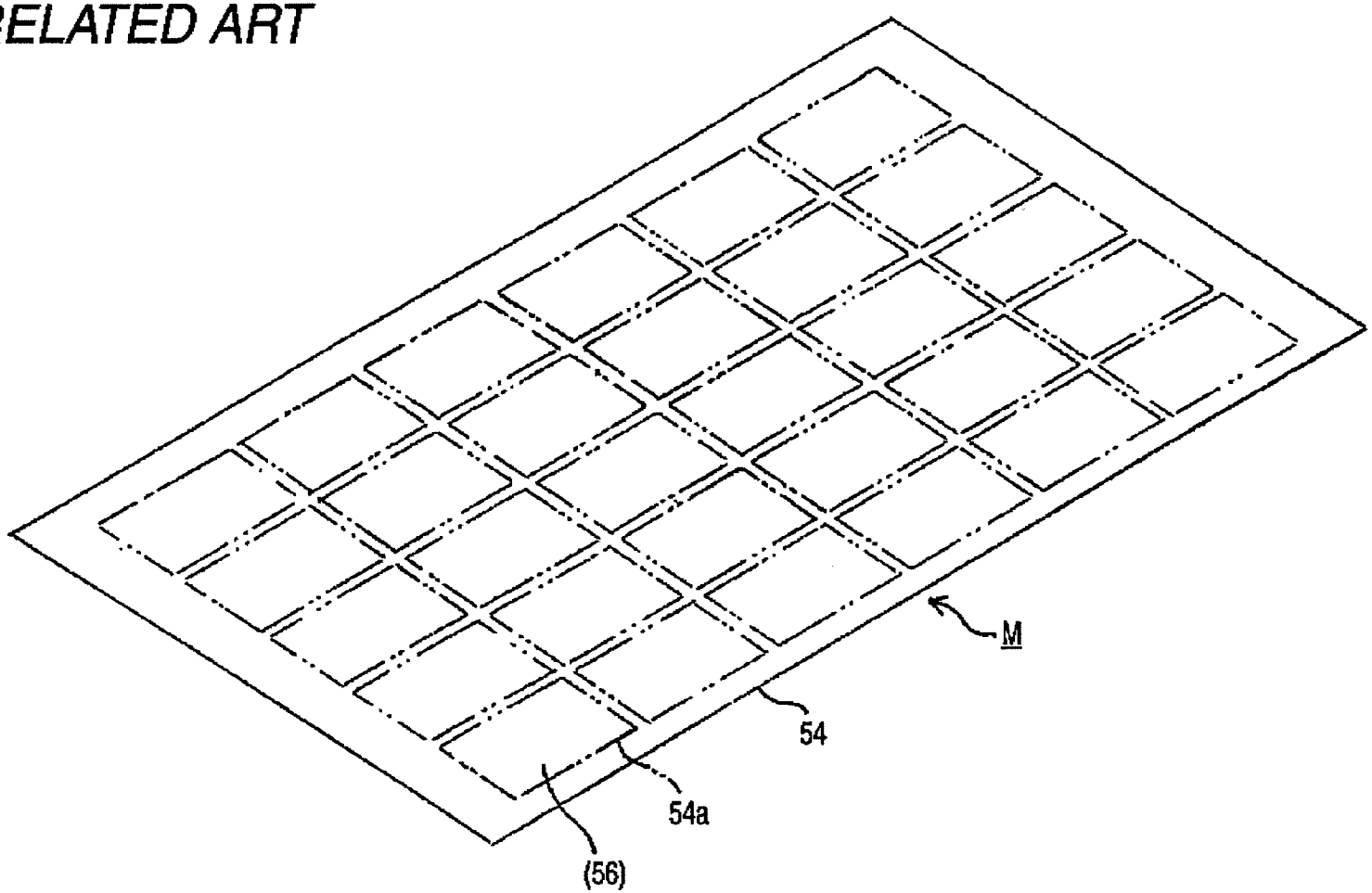
FIG. 17 RELATED ART
FIG. 17 is a perspective view of an insulating film according to the related art manufacturing method.
Figure 18:
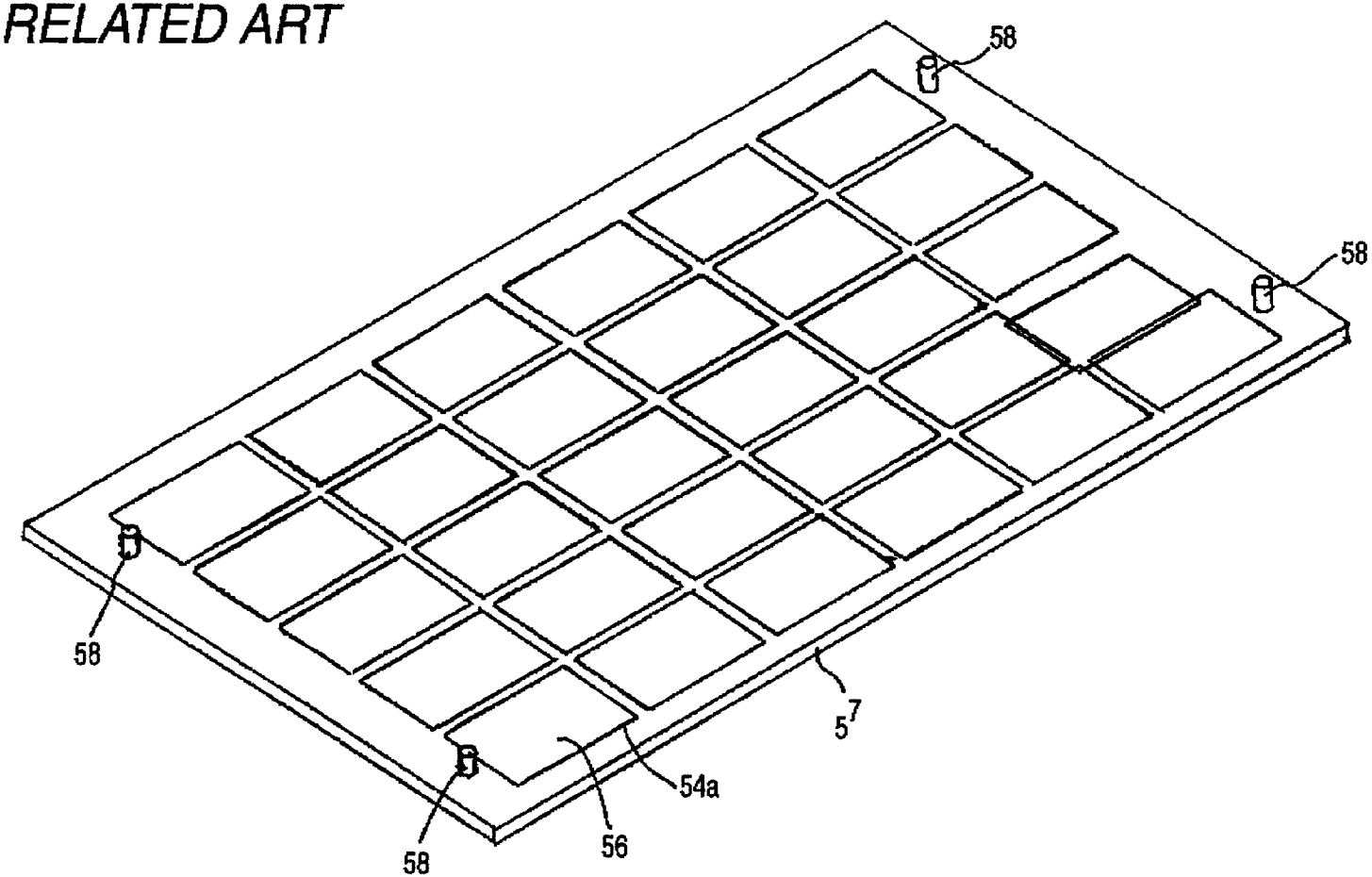
FIG. 18 RELATED ART
FIG. 18 is a perspective view of an insulating film piece arranged on a jig according to the related art manufacturing method.
Figure 19:
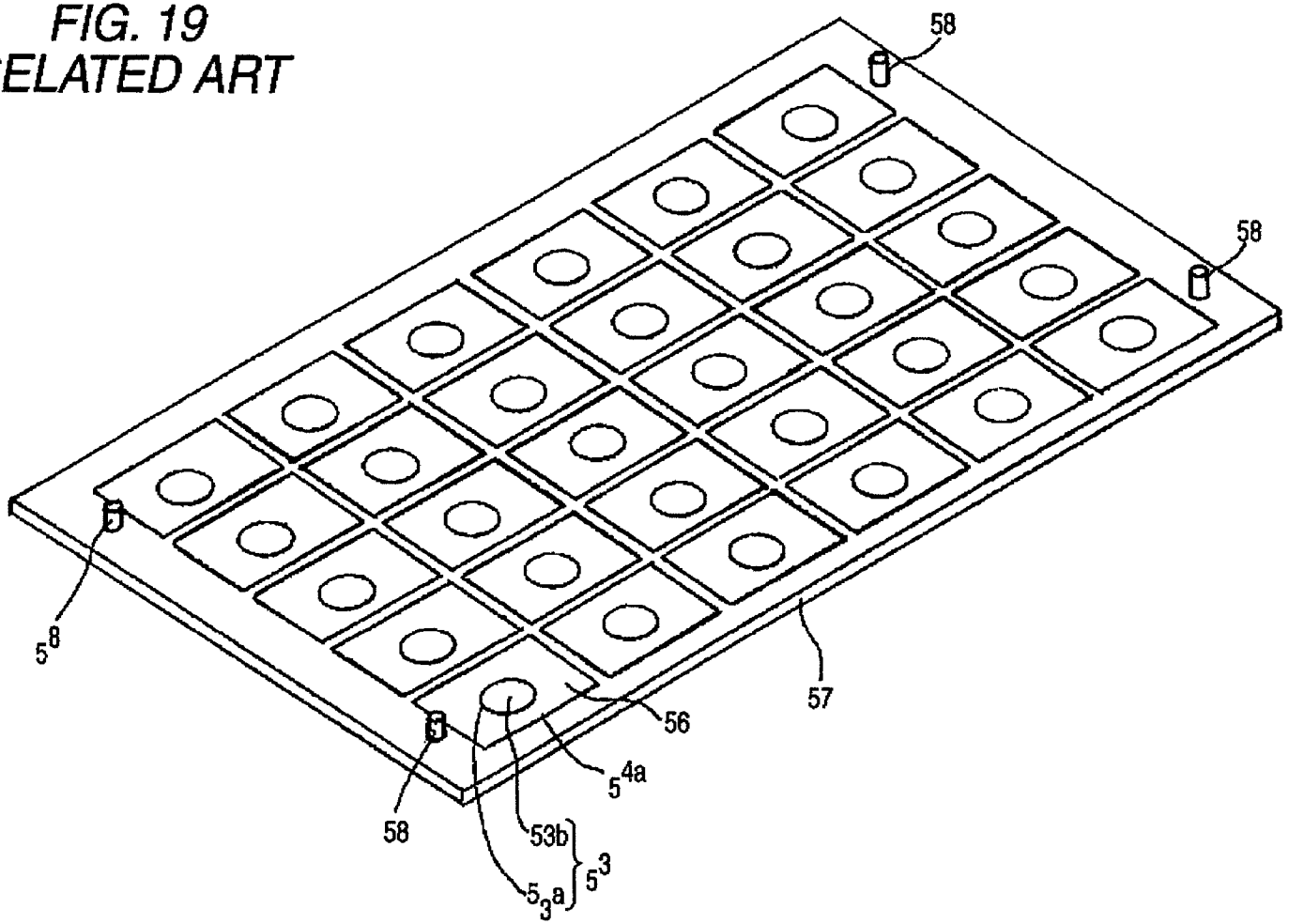
FIG. 19 RELATED ART
FIG. 19 is a perspective view of an insulating film piece and moving contacts arranged on a jig according to the related art manufacturing method.
Figure 20:
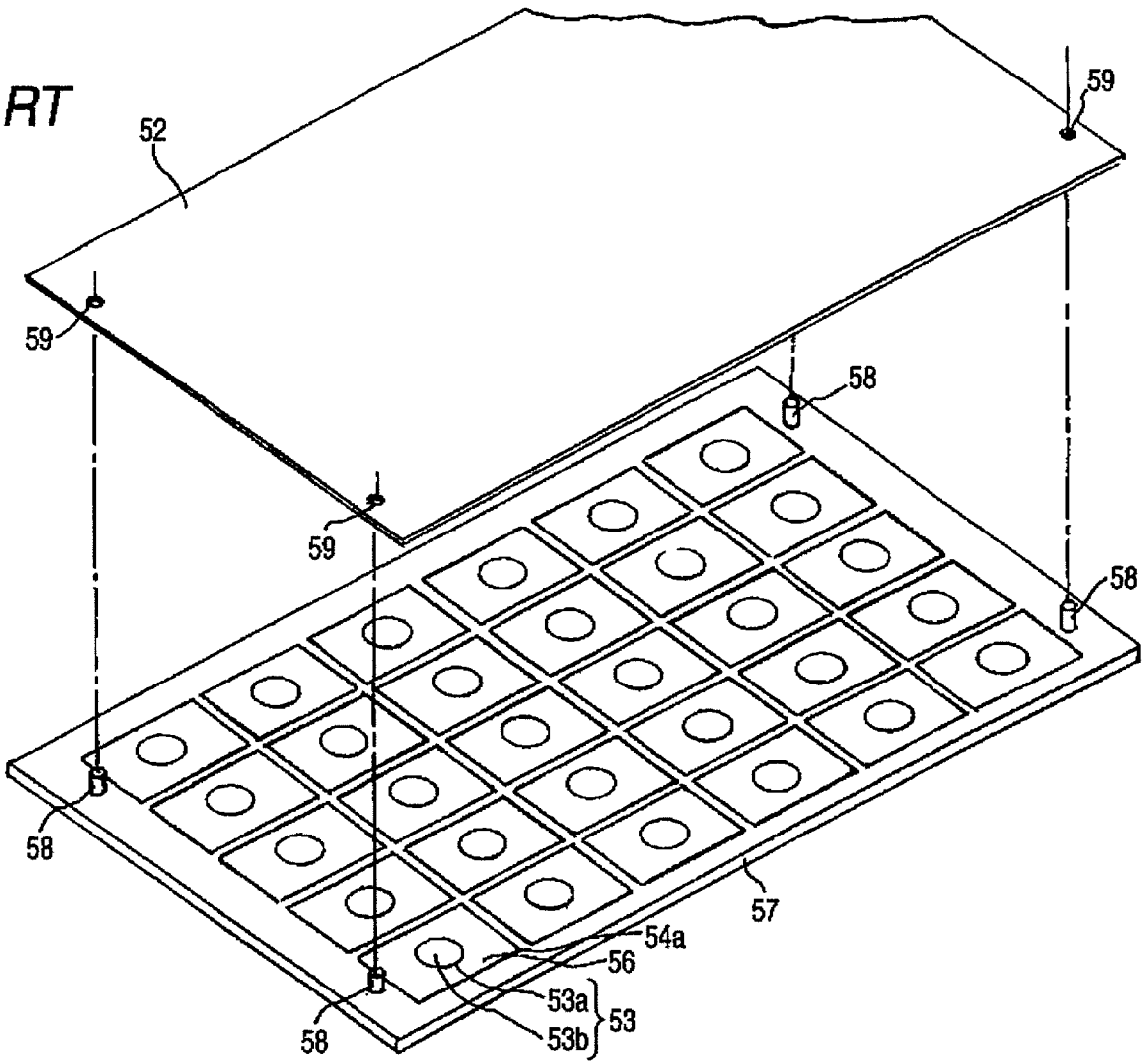
FIG. 20 RELATED ART
FIG. 20 is a perspective view of a wiring board arranged on a jig according to the related art manufacturing method.

After that, the process proceeds to the excess film removing operation D and in the same manner as that of the first exemplary embodiment, excess portions of the upper and the lower insulating film 4 are simultaneously cut by using the laser beam cutter 17. In this way, the upper and the lower insulating 4 having the moving contacts 3 are manufactured. FIG. 14 is a view showing a panel switch 21 manufactured when the upper and the lower insulating film 4 having the moving contacts 3 are put on each other, and the excess film has been removed. As in the panel switch according to the first exemplary embodiment, it is possible to use a separator 2B in place of the wiring board 2.

According to the manufacturing method according to the second exemplary embodiment, two insulating films 4, one being an upper insulating film and the other being a lower insulating film, are aligned and simultaneously cut. Consequently, there is no possibility that the upper and the lower insulating film 4 are positionally shifted. Accordingly, the upper and the lower insulating film 4 can be cut with high accuracy. Therefore, the two insulating films 4 can be more accurately cut and the product yield of the panel switch 21 can be improved.

The insulating film 4 of this panel switch 21 is composed in such a manner that the upper side moving contacts 3 and the lower side moving contacts 3 are vertically put on top of each other such that the upper side moving contacts 3 and the lower side moving contacts 3 positionally correspond to each other. See FIG. 11. Accordingly, when two insulating films 4 having the moving contacts 3 are put on each other on the wiring board 2 or the separator 2B, setting adjustments of adjusting the operation load (spring load) of the upper and the lower moving contacts 3 can be executed independently from each other on the two insulating films 4.

In this way, the setting adjustments for adjusting the operation load of the panel switch 21 can be set in a wide range with high accuracy because the operation load of the moving contacts 3 of two sheets of the upper and the lower insulating film 4 can be set independently. Accordingly, a "click" feeling made at the time of switch operation can be remarkably enhanced to be higher than that of the related art panel switch.

In the case where the panel switch is shipped in which the separator 2B is used instead of the wiring board 2 described above, the panel switch 1 or 21 may be attached to a wiring board 2 at a later time. In other words, the separator 2B allows an end user to attach the panel switch 1 or the panel switch 21 to a product, as desired.

According to exemplary embodiments of the present invention, an excess portion of the insulating film is removed in such a manner that the insulating film is irradiated with and cut by a laser beam under the condition that the moving contact and the insulating film are stuck onto the wiring board or the separator. Therefore, a panel switch may be produced without using a metallic die.

According to exemplary embodiments of the present invention, if the cutting profile is changed, it is possible to quickly change the cutting profile by adjusting a cutting program to be executed in a laser beam cutter.

According to exemplary embodiments of the present invention, in the case in which a plurality of insulating films are put on each other, a laser beam is simultaneously irradiated onto the plurality of insulating films and an excess portion is cut off. Therefore, no shift is caused in the sticking operation.

According to exemplary embodiments of the present invention, it is possible to manufacture a panel switch in which a plurality of switches having an insulating film and a moving contact are arranged on the same wiring board.

According to exemplary embodiments of the present invention, the image recognition device recognizes a moving contact and the laser beam cutter cuts an insulating film by irradiating a laser beam in reference to the moving contacts, so that an excess portion of the insulating film can be accurately removed.

According to exemplary embodiments of the present invention, two insulating films, which have been formed in the moving contact sticking operation, are put on each other and arranged on the wiring board or the separator. Accordingly, on the two respective insulating films, a setting adjustment of adjusting an operation load (i.e., a switch pushing load) of the moving contact can be executed independently from each other.

According to exemplary embodiments of the present invention, production can be executed without using a metallic die. Therefore, it is possible to eliminate the cost of manufacturing the metallic die and it is also possible to shorten a period of time of manufacturing the panel switch.

According to exemplary embodiments of the present invention, it is possible to quickly change the cutting profile by adjusting a cutting program to be executed by a laser beam cutter. Since it is possible to obtain an arbitrary cutting shape by using a laser beam cutter, it is possible to efficiently provide various designs of the panel switch as desired.

According to exemplary embodiments of the present invention, in a case in width a plurality of insulating films are put on each other, the plurality of insulating films can be simultaneously and accurately cut by irradiating a laser beam. Accordingly, no positional shift is caused between the plurality of insulating films, and a yield of manufacturing the panel switches can be increased. Further, it is possible to reduce a pitch between the plurality of moving contacts. Accordingly, an area of the excess portion of the insulating film can be reduced and made smaller than that of the related art panel switch.

According to exemplary embodiments of the present invention, a panel switch, on which a plurality of switches are arranged on the same wiring board or separator in parallel with each other, can be simply formed. Accordingly, a panel switch, the design of which is changed, can be provided at a low manufacturing cost.

According to exemplary embodiments of the present invention, it is possible to highly accurately cut off an insulating film by a laser beam cutter. Therefore, the product yield can be further increased.

According to exemplary embodiments of the present invention, if the two individual insulating films are put on each other, a setting adjustment of the operation load for each individual insulating film can be executed independently from each other. Therefore, the operation load can be set in a wide range with high accuracy and a "click" feeling at the time of operating the switch can be enhanced over that of the related art panel switch.

According to exemplary embodiments of the present invention, since the production of switch panels can be accomplished without using a metallic die, the manufacturing cost can be reduced.

According to exemplary embodiments of the present invention, in the case of changing a cutting profile of the insulating film, it is possible to quickly cope with the change of the profile by adjusting a cutting program to be executed by a laser beam cutter.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. A method of manufacturing a panel switch, the method comprising:

applying an adhesive layer on a side of a first insulating film;

adhering an apex portion of a moving contact onto the adhesive layer of the first insulating film;

providing a base member comprising a stationary contact;

aligning the moving contact with the stationary contact;

adhering the first insulating film to the base member so as to fix the moving contact to the base member;

applying an adhesive layer on a side of a second insulating film;

adhering an apex portion of a moving contact onto the adhesive layer of the second insulating film;

aligning the moving contact of the second insulating film with the moving contact of the first insulating film;

adhering the second insulating film on top of the first insulating film such that the moving contact of the first insulating film, the moving contact of the second insulating film and the stationary contact align in a direction orthogonal to a surface of the base member, thus forming an insulating film assembly; and irradiating the insulating film assembly with a laser beam so as to cut off and remove an excess portion of the insulating film from the insulating film assembly.

* * * * *